United States Patent [19]

Nuñez

[11] 4,302,037

[45] Nov. 24, 1981

[54] LATCH FASTENER FOR WINDOWS, DOORS OR THE LIKE

[75] Inventor: Dario Nuñez, Santiago, Chile

[73] Assignee: Metalurgica Rodynet Ltda., Santiago, Chile

[21] Appl. No.: 31,610

[22] Filed: Apr. 19, 1979

[30] Foreign Application Priority Data

Nov. 14, 1978 [AR] Argentina ..... 274437

[51] Int. Cl.[3] ..... E05C 1/10

[52] U.S. Cl. ..... 292/128; 292/DIG. 57

[58] Field of Search ..... 292/175, 252, DIG. 57; 308/3 R, 3 A, 3.6, 3.8, 3.9, 6 R

[56] References Cited

U.S. PATENT DOCUMENTS

| | | | |
|---|---|---|---|
| Re. 8,645 | 4/1879 | Sparks . | |
| 152,009 | 6/1874 | Robinson . | |
| 176,698 | 4/1876 | Blank et al. . | |
| 329,494 | 11/1885 | Schweinfurt | 292/175 |
| 373,442 | 11/1887 | Clark | 292/DIG. 57 |
| 682,959 | 9/1901 | Seng | 292/175 |
| 701,892 | 6/1902 | Kennedy | 292/DIG. 57 |
| 860,412 | 7/1907 | Robinson . | |
| 1,005,055 | 10/1911 | Miller | 308/3.8 X |
| 1,134,038 | 3/1915 | Demiyian | 292/175 |
| 1,189,969 | 7/1916 | Kimball . | |
| 1,261,507 | 4/1918 | Gabriel | 308/6 X |
| 1,443,789 | 1/1923 | Humphreys | 308/6 X |
| 1,521,572 | 12/1924 | Hammer et al. | 292/128 |
| 1,537,067 | 5/1925 | Card | 308/6 X |
| 2,001,999 | 5/1935 | Bishop | 308/3.8 X |
| 2,240,400 | 4/1941 | Johnson | 292/DIG. 57 |
| 3,103,713 | 9/1963 | Ahlgren | 292/175 |
| 3,173,716 | 3/1965 | Silvers | 292/147 |
| 3,374,020 | 3/1968 | Berg | 292/175 |
| 3,501,188 | 3/1970 | Korkos | 292/175 |
| 3,694,048 | 9/1972 | Middleton | 308/3.6 X |
| 4,139,249 | 2/1979 | Hillman | 292/175 X |

*Primary Examiner*—Richard E. Moore

*Attorney, Agent, or Firm*—Pennie & Edmonds

[57] ABSTRACT

A latch fastener for construction elements such as windows, doors or the like which includes a base member and a movable member having a latching hook configured to cooperate with a fixedly secured striker plate for selectively locking and unlocking the window or door. The members have positioned therebetween, several bearing balls which facilitate movement of the movable member and latching hook relative to the base member between at least two positions corresponding to the locked and unlocked positions of the window or door. The base member and movable member include correspondingly oppositely positioned tracks which define races for the bearing balls and which permit rolling movement of the bearing balls when the movable member is moved relative to said base member. A resilient spring retains the movable member and latching hook in a normal position corresponding to a locked position of the window or door as the case may. The latch fastener provides unique continuous and smooth operation which facilitates positive locking of the door or window and avoids the wear and deformation on the components normally caused by shock forces to which they are subjected when the door or window is closed. This advantage is provided by the translation of such shock forces from their initial direction which promotes friction to a direction perpendicular thereto.

23 Claims, 12 Drawing Figures

LATCH FASTENER FOR WINDOWS, DOORS OR THE LIKE

FIELD OF THE INVENTION

The present invention relates to an improved latch fastener particularly suitable to be used in doors and windows of the sliding type.

DESCRIPTION OF THE PRIOR ART

Various types of latches for sliding doors and windows are known, but all of the known latches present some problems and inconveniences. For example, certain latches lack the requisite mechanical strength required and others are difficult or unusually stiff in their operation, due or caused by strains and/or deformations produced by the normal wear and tear of daily use. In many of the latches currently available, it is necessary to trasmit forces on the locking portion from a first direction to a second direction and movable components are frictionally engaged and moved relative to fixed components. Thus, normal wear and tear on the device will often cause the movements of the components to increasingly deteriorate until it becomes necessary to replace the device. I have invented a latch device which is safe, and which has substantially improved strength characteristics, while being capable of extremely smooth and reliable operation even when subjected to strong shocks or abuse. Thus, my invention avoids the problems and disadvantages of the prior art latches and makes it possible for sliding windows and doors to operate with simplicity and ease previously unknown.

SUMMARY OF THE INVENTION

Broadly stated, the invention relates to a latch fastener which comprises a base member and a movable member having latching means, rolling means positioned and retained between the members to facilitate movement of the movable member and latching means between at least two positions corresponding to locked and unlocked positions of the latching means. In preferred embodiments, the latch fastener is constructed of two members, one base member and a second member movable relative to the base member, the second member having a latching hook adapted to cooperate with a plate member having an opening configured to receive the latching hook to lock the door or window, as the case may be.

The latching hook may extend in any number of directions depending upon the particular installation contemplated. For example, the base member may be secured by suitable fasteners to either a window or a door while a frame portion is dimensioned and configured to operate as the strike plate. Alternatively, the base member may be secured by suitable fasteners to a frame member of the window or door opening and a portion of the actual construction element (i.e., window, door, etc.) may be configured and dimensioned to function as the cooperating strike plate. In addition, multiple windows or multiple doors may be locked to each other with a portion of one window functioning, for example, as a strike plate and the other window having the latch fastener attached thereto.

In one preferred embodiment, the latch fastener includes two plate members of stainless steel, one fixed, the other movable, and both plate members have formed channels which define races in which generally spherical bearing balls are positioned. Both plate members are retained in face-to-face relation by suitable fasteners such as rivets having enlarged heads, positioned within slots in a manner to accommodate movements of the movable member. The movable member is preferably biased by a resilient coil spring to maintain the latching means—i.e., latching hook—in a position corresponding to the locked position of the door or window.

While at least two rivets are preferred to retain the plate members in a stable face-to-face relation and to prevent relative rotation which may be caused by slamming the door or window, in one embodiment, bearing races are formed along edge portions of the plate members and four bearing balls are equally spaced to provide relative stability for the movable member and the base member, thus obviating the need for two rivets. In such case one rivet is sufficient to retain the members in face-to-face relation and the bearing balls prevent relative shifting thereof.

In still another embodiment, the movable member has an elongated generally cylindrical configuration and the base member is somewhat cylindrical in part and defines a central opening in which the movable member is positioned for movements in a direction parallel to the central axes of the members. In this embodiment each member defines channels opposed from each other to function as races in which roller means such as generally spherical bearing balls are positioned. The bearing balls permit smooth sliding movement of the movable member and they retain the members in substantially fixed aligned relation such that their axes are coincident.

Although the bearing ball races are defined by channels of several cross sectional configurations, any suitable channel configuration is contemplated (i.e., arcuate, spherical, square, "V"-shaped, etc.) provided that the bearing balls may function to provide smooth sliding movements of the movable member.

Although the latch fastener of the invention may be constructed of stainless steel, brass, bronze, antimony it may also be constructed of a suitable synthetic plastic material such as ABS, nylon, polyvinyl chloride, polypropylene, etc.

It will be readily appreciated from the description which follows that the present invention uniquely transfers forces normally subjected to the latching hook from their initial direction to a direction approximately perpendicular to their first direction. This transfer is accomplished with minimum friction and in a continuous smooth manner. Thus locking of the window or door is accomplished with less force and the normal wear and tear on the latching hook and strike plate is minimized. In addition, actual wear and tear on the entire device is eliminated.

By providing a replaceable coil spring, the movable member and attached latching hook are biased toward the "locked door or window" position thus maintaining the door or window in the locked position.

Although it is preferably contemplated to utilize my latch fastener with sliding doors or windows, it is foreseen within the scope of my invention to utilize it with any components which must be secured in one of several positions at different times. Thus, by "construction element" I contemplate such components as doors, windows, trunk lids or any other components which must be retained in one of several positions at different times.

DESCRIPTION OF THE DRAWINGS

Preferred embodiments of the invention are described hereinbelow with reference to the drawings wherein.

BEST MODE FOR CARRYING OUT THE INVENTION

Figure 1:
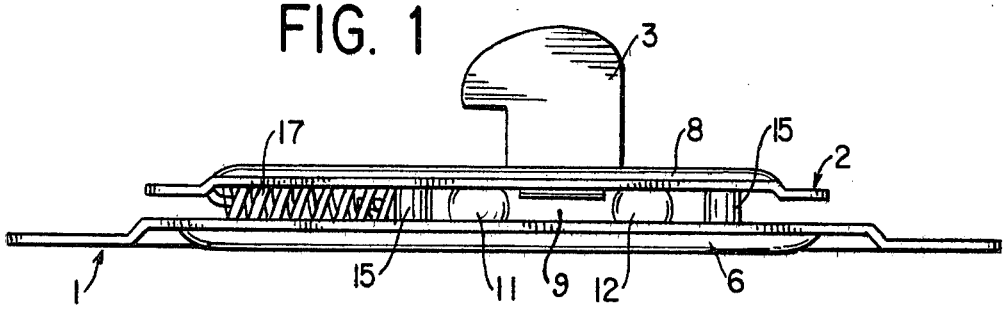
FIG. 1 is a side elevational view of the improved latch fastener of the invention, in assembled condition.
Figure 2:
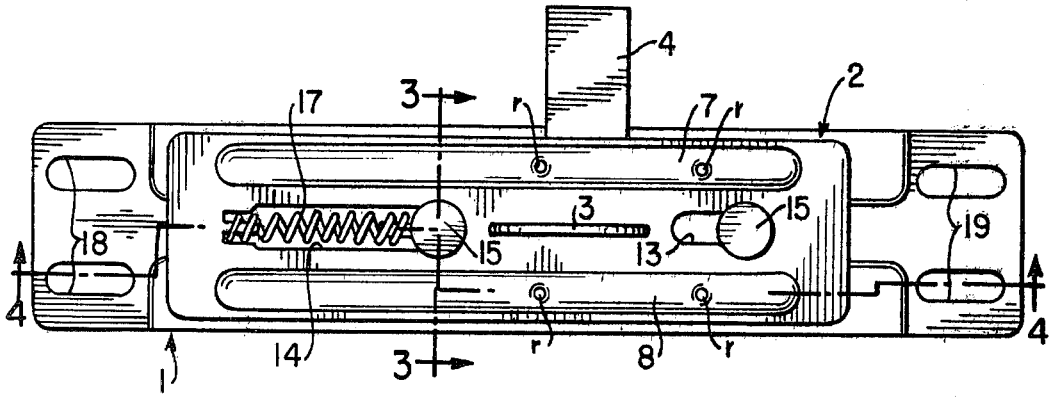
FIG. 2 is an upper plan view of the latch fastener of the invention.

Referring to FIG. 1, there is illustrated a latch fastener according to the invention. The latch fastener includes a base plate 1 and a movable plate 2 which is provided with a "hook" or latch 3 and an "arm" or actuating wing 4. The "hook" and "arm" are fixed to the movable plate 2 by conventional means such as welding or riveting.

Figure 3:
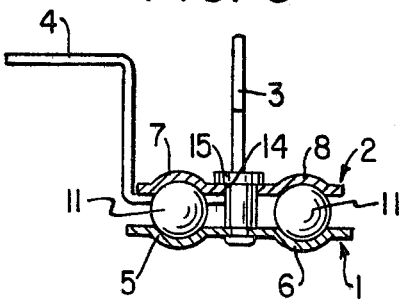
FIG. 3 is a sectional view taken along the line 3—3 of FIG. 2.

Both the base plate 1 and the movable plate 2 are provided with formed channels or guides 5, 6, 7, and 8, respectively (FIGS. 3 and 4), the channels being parallel to each other and to the major axis of each plate.

Between each channel 5, 6 of the base plate 1 and the respective channels 7, 8 of the movable plate 2 "races" 9 and 10 are defined (FIGS. 1 and 4) wherein at least two spherical rollers 11 and 12 (or roller balls) are located in each of said "races." The rollers 11 and 12 determine a spaced relationship between the base plate 1 and the movable plate 2. Preferably, the channels 5, 6, 7, and 8 are provided with small outwardly extending projections "r" (FIG. 4) for limiting the longitudinal displacement of the spherical rollers. The movable plate 2 is provided with two substantially elongated slots 13, 14 located near the respective ends of the plate and along the major axis of the plate 2.

Figure 4:
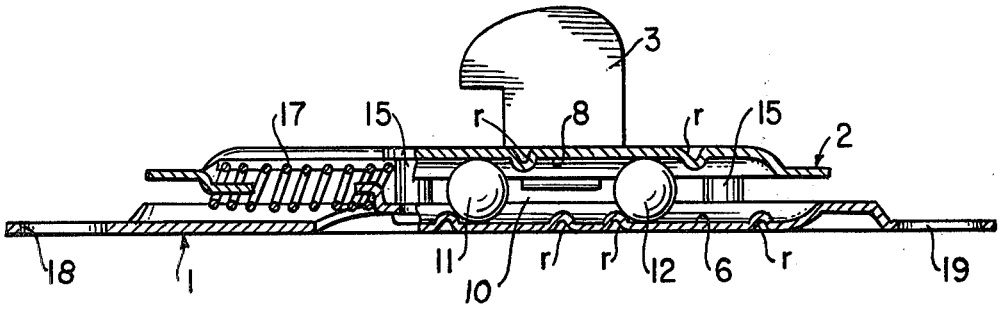
FIG. 4 is a sectional view taken along the line 4—4 of FIG. 2.

Holding pins or rivets 15 (FIG. 1) provided with heads having a diameter larger than the width of the slots 13, 14 pass through the slots and are affixed to the base plate 1 of the latch, as shown in FIG. 4.

Preferably, the slot 14 that is adjacent to the open end or "nose" of the hook 3 is substantially longer than the slot 13 located in the other end of the movable plate 2. An elastic means 17 such as an helicoidal spring is positioned within the longer slot 14 with one end of the spring abutting against a suitable location in the movable plate 2 and the other end abutting against the corresponding pin or rivet 15 in the slot 14, or against a suitable location in base plate 1. Thus the movable plate 2 is normally biased to the "locked window" position shown in FIG. 1, in relation to the base plate 1, by the action of the force exerted by said spring 17. The spring 17 is conveniently and simply replaceable after extensive wear from continued use.

Conveniently, the outer ends of the base plate 1 are flattened and can be provided with one or more elongated slots 18, 19 to facilitate the installation of the latch fastener in a window sill or door frame or the like by means of suitable fasteners such as self-tapering screws or the like, and the corresponding adjustment or setting relative to the recess in the window frame wherein the "hook" shall engage when the window is in the closed position.

Figure 5:
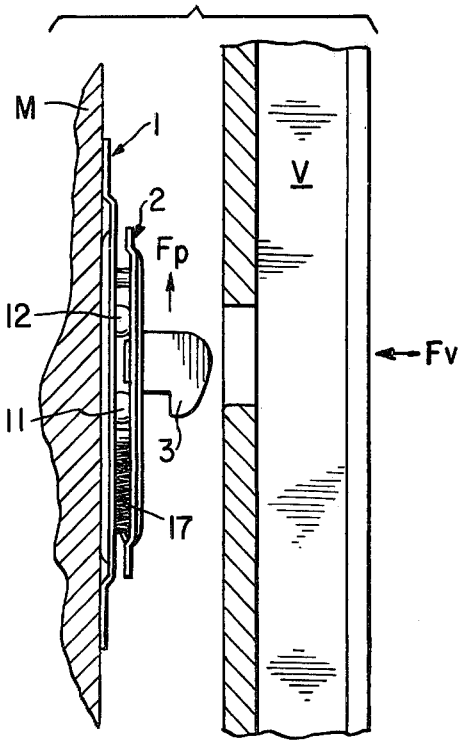
FIG. 5 is an illustration of the latch of the invention mounted on a window sill and ready to operate in cooperation with a strike plate.

The operation of the latch fastener will be described with reference to FIG. 5. The base plate 1 of the latch is installed in the window sill "M" in such a position that the hook 3 is positioned facing the opening or recess provided in the sliding window frame "V" which functions as a striker plate.

When the sliding window is moved in the direction of the arrow "$F_v$" the impact of the lower edge of the recess in the window frame upon the curved portion of the hook 3 forces the movable plate 2 against the spherical rollers 11, 12 and produces the displacement of the movable plate 2 in the direction shown by the arrow "$F_p$", the plate smoothly slides on the spherical rollers and compresses the helical spring 17. Thus engagement forces and translated to forces at a direction 90 degrees from the shock forces.

When the hook 3 has been totally displaced in the direction of the arrow "$F_p$" and the sliding window "V" abuts the window sill "M"—after the hook 3 has penetrated in the recess provided in the window frame—the movable plate 2 biased by the spring 17, is forced back to its normal position, thus producing the latching of the sliding window through the nose of the hook 3.

The operating arm 4 preferably projecting outwardly from the window sill, provides the means to displace the movable plate 2 in the direction of the arrow "$F_p$" while simultaneously the window frame is moved in a direction opposed to the arrow "$F_v$" to the opened position.

The embodiments of FIGS. 6–8 and FIGS. 9–12 are similar in many respects to the embodiments of FIGS. 1–5. Accordingly, in the description of the embodiment of FIGS. 6–8, elements corresponding to like elements of the embodiments of FIGS. 1–5 bear like numbers, but will have "100" added. In a similar manner, elements of the embodiment of FIGS. 9–12 will bear the same number as like elements in the embodiments of FIGS. 1–5 but will have "200" added to them. Accordingly, the element of the embodiment of FIGS. 6–8 corresponding to element 5 of the first embodiment will be identified by numeral "105", while the like element of the embodiment of FIGS. 9–12 will be identified by numeral "205".

Figure 6:
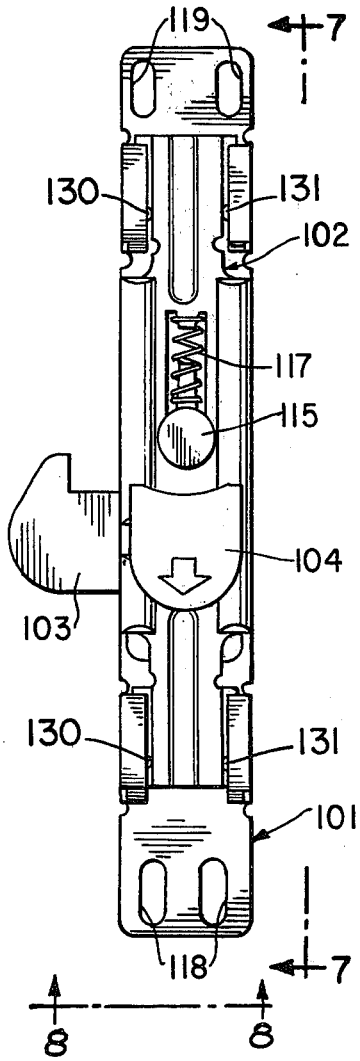
FIG. 6 is an upper plan view of an alternate embodiment of the invention.
Figure 7:
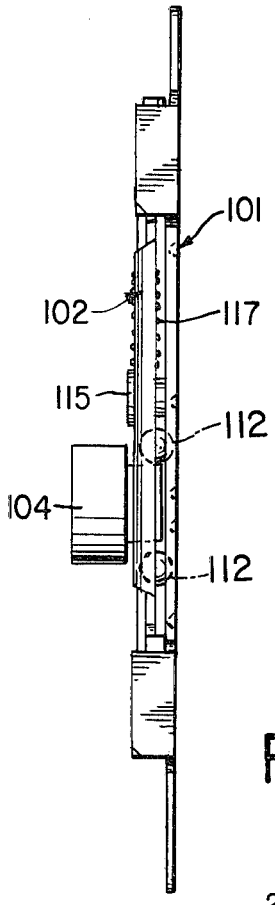
FIG. 7 is a view taken along line 7—7 of FIG. 6.
Figure 9:
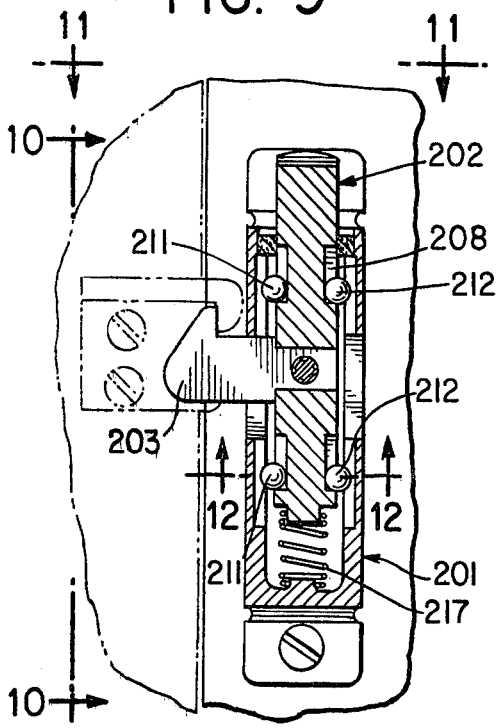
FIG. 9 is an upper plan view of a second alternate embodiment of the invention in position in a sliding door or window.
Figure 10:
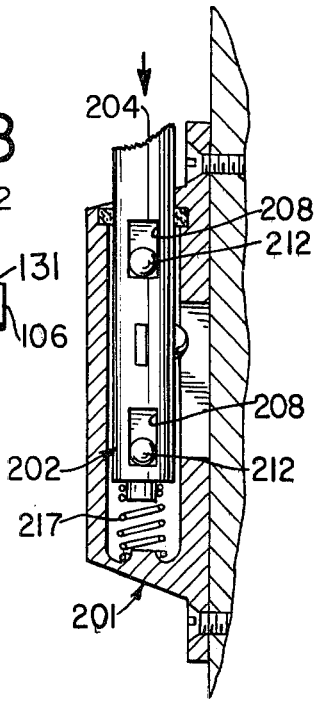
FIG. 10 is a view taken along line 10—10 of FIG. 9.
Figure 11:
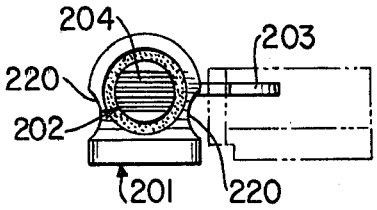
FIG. 11 is a view taken along line 11—11 of FIG. 9.
Figure 8:
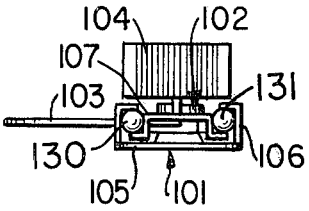
FIG. 8 is a view taken along line 8—8 of FIG. 7.

Referring now to FIGS. 6–8 there is illustrated an alternate embodiment of the invention. The latch fastener of these FIGS. includes a base plate 101 and a movable plate 102 provided with a "hook" or latch 103 and an arm or actuating wing 104. The base plate 101 and the movable plate 102 are maintained in the same spaced apart relation as the embodiment of FIG. 1 and operate in a similar manner to that embodiment. However, in the embodiment of FIG. 7, the edge portions of both plates are formed into channels 105–107, respectively, so as to define the "races" for spherical roller balls 111 and 112. Only roller balls 112 are shown in FIG. 7; however, roller balls 111 are directly behind, and identical to, roller balls 112 in FIG. 7. Thus, with two spherical rollers 111 positioned in spaced relation along one side of the latch fastener and two spherical roller balls 112 similarly positioned opposite the first pair of rollers, the base plate 101 and movable plate 102 are restrained from lateral or rotational movements with respect to each other and a single rivet 115 thus retains the plates in assembled relation. Two pairs of spherical roller balls 130 and 131 as shown in FIGS. 6 and 8 are also provided.

In operation, the latch fastener of FIG. 6 is identical to the latch fastener of FIG. 1 with latch 3 being biased in the "locked window" position by helical spring 117. However, it will be readily appreciated that when the latch fastener of FIG. 6 is subjected to the normal shocks of daily use, the base plate 101 and the movable plate 102 do not shift laterally, and do not rotate with respect to each other. Slots 118 and 119 are provided to secure the latch fastener to a window sill or door frame or the like as illustrated in connection with the embodiment of FIGS. 1–5.

Referring now to FIGS. 9–12, there is illustrated still another preferred embodiment of the invention. The latch fastener of these Figs. includes a base member 201 configured somewhat cylindrically in part, and a movable member 202 provided with a "hook" or latch 203. In this embodiment an extension of the movable member 202 functions as an arm or actuating wing 204, while movable member 202 is biased toward the "locked window" position by spring 217 in the same manner as described with respect to the previous embodiments.

The base member 201 and the movable member 202 are maintained in spaced radial relation to accommodate spherical roller balls 211 and 212 positioned in races defined respectively by "V" shaped notch channels 205 and 206 formed in base member 201, and opposed channels 207 and 208 respectively formed in movable member 202. Retention of spherical roller balls 211 and 212 is provided by appropriately positioned projections such as projections "r" illustrated in connection with the embodiment of FIG. 1, or alternately other suitable means may be provided to retain the rollers 211 and 212 with the races defined by notch channels 205 and 206 and opposed channels 207 and 208.

Notwithstanding the distinctions between the configurations of the components of the embodiments of FIGS. 1 and 6 and the embodiment of FIGS. 9–12, the operation of the latter embodiment is similar to the previously described embodiments. Thus movable member 201 is biased in the "locked window" position by helical coil spring 217 and slidably moves relative to the base member 201 in a smooth, continuous and reliable manner. The equally spaced positions of rollers 211 and 212 as shown, provide relative stability of movable member 202 with respect to base member 201, thus eliminating any possibility of lateral or rotational shifting of the movable member. In addition, suitable openings or slots are provided for securing the base member 201 to the window panel, window sill, door, door frame, or the like.

Figure 12:
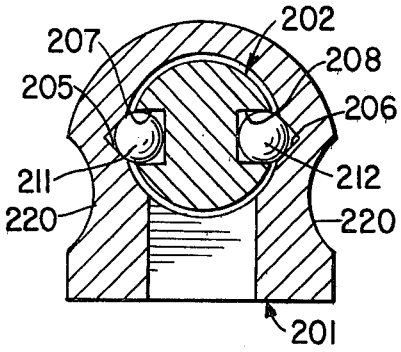
FIG. 12 is a cross-sectional view taken along line 12—12 of FIG. 9.

The embodiment of FIGS. 9–12 provides certain additional advantages over the embodiments of FIG. 1–8 in that the base member is shaped in part somewhat similarly to a cylindrical member as shown best in FIG. 12. This configuration renders it possible to grip the base member 201 by placing the fingers in respective radiused cutouts 220. Thus, when the latch fastener is arranged to be secured to the actual window panel or door, the windows or door—as the case may be—may be closed by gripping the base member. In addition, it will be readily appreciated that movable member 202 may be manually moved to the "unlocked" position by depressing actuating wing 204 with the thumb while gripping the base member 201.

In addition, it will be readily appreciated that the embodiments of my invention can be readily mass produced inexpensively of any suitable materials including metals such as stainless steel, zamac, aluminum, bronze, brass, antimony or plastics such as polyvinyl chloride (PVC), acrilonitrile butadiene styrene terpolymer (ABS), nylon, polypropylene or the like. In either case, the components may be formed by casting, stamping, etc., or injection molding. Because of the relatively compact constructional arrangement of the embodiment of FIGS. 9–12 it will be appreciated that this embodiment may be more readily constructed of a synthetic plastic material without compromising the strength of the fastener. This aspect will render it possible to produce this embodiment in mass quantity and at reduced cost.

It is to be understood that many changes and modifications in the form, location and arrangement of the parts conforming the latch of the invention are possible and evident to those skilled in the art, without departing from the spirit and scope of the invention.

I claim:

1. A latch fastener for construction elements such as windows, doors or the like which comprises a base member, and a movable member having latching means configured to cooperate with a structural member to lock and unlock the construction element, said base member and said movable member respectively including at least two substantially longitudinally extending and parallel races configured to retain rotatable bearing members therebetween, at least two rotatable bearing members positioned in spaced relation within each race so as to retain said base and movable members in spaced relation and to facilitate movement of said movable member and latching means relative to said base member in directions generally parallel to said races and to positions corresponding to locked and unlocked positions of the construction element while said bearing members rotatably move within said races therebetween, and means positioned and adapted to maintain said base and movable members and said bearing members in assembled relation while permitting movements of said movable member relative to said base member.

2. The latch fastener according to claim 1 wherein said movable member is biased to a normally locked position by resilient means extending between respective portions of said base member and movable member.

3. The latch fastener according to claim 2 wherein said base member includes longitudinal parallel channels and said movable member is provided with correspondingly positioned opposed channels to define said races for reception of said rotatable bearing members.

4. The latch fastener according to claim 3 wherein said rotatable bearing members are in the form of generally spherical bearing balls.

5. The latch fastener according to claim 3 further comprising means for limiting the movements of said bearing balls within said races.

6. The latch fastener according to claim 5 wherein said base member is in the form of a base plate and said movable member is in the form of a movable plate.

7. The latch fastener according to claim 6 wherein said channels are formed in said respective base plate and movable plate.

8. The latch fastener according to claim 7 wherein said channels are stamped in said respective base plate and movable plate, and projecting stops are provided within said channels for limiting the movements of said roller balls within said races.

9. A latch fastener for construction elements such as windows, doors or the like which comprises a base member and a movable member having latching means configured to cooperate with a fixedly secured strike member for selectively locking and unlocking the construction element, at least two rotatable bearing members positioned on either side of a generally central axis extending generally longitudinally of said members and along the directions of movement of said movable member, said bearing members being in spaced relation to each other and positioned for rotation in associated substantially parallel races defined by said members, said bearing members being configured and dimensioned to maintain said movable member spaced from said base member and adapted to facilitate movement of said movable member and latching means relative to said base member between at least two positions corresponding to locked and unlocked positions of said construction element, means to retain said base member and movable member in assembled spaced relation and said bearing members therebetween while permitting movements of said movable member relative to said base member along said generally longitudinal axis.

10. A latch fastener for construction elements such as windows, doors or the like which comprises a base plate member and a movable plate member having a latching hook, said base plate member and movable plate member being respectively provided with generally longitudinally extending substantially parallel channels having generally arcuate cross sectional configurations and facing each other to define bearing races between said plate members on either side of a generally central axis extending substantially longitudinally of said members and substantially along the directions of movement of said movable plate member, at least two generally spherical rotatable bearing members positioned in each race so as to retain said plate members in spaced relation and to facilitate relatively continuous slidable movement of said movable plate member and latching hook relative to said base plate member in directions generally parallel to said races and to positions corresponding to locked and unlocked positions of the construction element while said rotatable bearing members rotatably move within said races therebetween, fastener means positioned between said races to retain said movable plate member in spaced and assembled relation with respect to said base plate member.

11. A latch fastener for construction elements such as sliding windows, doors or the like which comprises a base plate member and a movable plate member having a latching hook configured to cooperate with a correspondingly configured structural member such as a strike plate, said base plate member and said movable plate member being provided with integrally formed longitudinally extending substantially parallel channels on either side of a generally central axis extending generally longitudinally of said plate members and in the directions of movement of said movable plate member, each having a generally semicircular cross sectional configuration and facing each other in opposed spaced relation to define races therebetween, at least two generally spherical bearing balls positioned on either side of said longitudinal axis and within said races, said bearing balls being dimensioned and configured to retain said plate members in spaced relation and to allow the movable plate member to move smoothly relative to said base plate member in directions generally parallel to said races when said movable plate member and latching hook are moved to and from positions corresponding respectively to locked and unlocked positions of the construction element, fastener means positioned between said races to maintain said plate members in spaced and assembled relation.

12. A latch fastener for locking and unlocking construction elements such as sliding windows, doors or the like which comprises a base plate member and a movable plate member having a latching hook, said base plate member and movable plate member being provided with integrally formed longitudinally extending substantially parallel channels on either side of a generally longitudinally extending, generally centrally positioned axis, each channel having a cross sectional configuration capable of receiving generally spherical bearing balls for rotatable movement therein and facing each other in opposed relation to define races therebetween, at least two generally spherical bearing balls positioned within said races on each side of said longitudinal axis to retain said plate members in fixed spaced relation and to allow the movable plate member to move smoothly relative to said base plate member in directions generally parallel to said races when said movable plate member and latching hook are moved between locked and unlocked positions of the construction element relative to a structural member such as a strike plate, fastener means to maintain said plate members in spaced assembled relation and to retain said bearing balls in position between said plate members while permitting relatively smooth movements of said movable plate member relative to said base plate member, and resilient spring means positioned and adapted to bias said movable plate member and latching hook toward the locked position.

13. A latch fastener for locking and unlocking construction elements such as sliding windows, doors or the like which comprises a base plate member and a movable plate member having a latching hook affixed thereto, said base plate member and movable plate member being provided with integrally formed spaced longitudinally extending substantially parallel channels along opposite marginal portions thereof, each channel having a generally semicircular cross sectional configuration capable of receiving generally spherical bearing balls and facing each other in opposed relation to define races therebetween, at least two generally spherical bearing balls positioned within each race so as to retain said plate members in fixed spaced relation and to allow the movable plate member to move smoothly relative to said base plate member in directions generally parallel to said channels when said latching hook and said movable plate member are moved between locked and unlocked positions of the construction element relative to a structural member such as a strike plate, means to retain said bearing balls in position between said plate members, fastener means positioned between said races to retain said plate members in said fixed spaced relation, and means to manually move said movable plate member and latching hook between the locked and unlocked positions relative to the strike plate.

14. A latch fastener for construction elements such as windows, doors or the like which comprises a base plate member and a movable plate member having a latching hook configured to cooperate with a strike plate to lock and unlock the construction element, said base plate member and movable plate member being respectively formed with generally longitudinal substantially parallel channels extending longitudinally along opposite edge portions and facing each other to define races between said plate members, at least two generally spherical bearing balls positioned within each race so as to retain said plate members in spaced relation and to facilitate relatively continuous slidable movement of said movable plate member and latching hook relative to said base plate member in directions generally parallel to said races and to positions corresponding to locked and unlocked positions of the construction element while said bearing balls rotatably move within said races therebetween, the spaced positions of said bearing balls maintaining said plate members in relatively stable face-to-face relation, notwithstanding shock forces to said latching hook caused by locking the construction element, at least one fastener means such as a rivet to maintain said plate members in assembled relation while permitting slidable movement of said movable plate member relative to said base plate member.

15. A latch fastener for construction elements such as windows, doors or the like which comprises a first member having latching means for locking the construction element, a second member adapted to be fixedly secured to the construction element or to an adjacent frame portion, said second member at least substantially surrounding said first member in a manner to define a space therebetween, said first member being movable relative to said second member in directions generally parallel to a generally central longitudinal axis toward and away from a position which places said latching means in correspondingly locked engagement with a cooperating structural member such as a strike plate for locking the construction element, resilient spring means to bias the first member toward a normal position corresponding to the locked position of the construction element, at least two bearing members positioned for rotation on either side of said axis in respective races defined by said first and second members to facilitate slidable relatively smooth movement of said first member relative to said second member when said first member and said latching means are moved to lock and unlock the construction element, fastener means to maintain said members in assembled relation while permitting movements of said first member relative to said second member.

16. The latch fastener according to claim 15 wherein said first and second members include correspondingly opposed channels to define races for said rotatable bearing members.

17. The latch fastener according to claim 16 wherein said rotatable bearing members are in the form of generally spherical bearing balls.

18. The latch fastener according to claim 17 wherein said second member is adapted to be fixedly secured to the construction element.

19. The latch fastener according to claim 18 wherein said second member is configured to be conveniently gripped for the purpose of moving the construction element between associated closed and opened positions.

20. The latch fastener according to claim 19 wherein said latching means is in the form of a latch hook adapted to become locked and unlocked in cooperation with a correspondingly configured strike plate secured to at least one of a frame member and another construction element.

21. The latch fastener according to claim 20 wherein said first and second members are constructed of at least one of stainless steel, bronze, and brass.

22. The latch fastener according to claim 20 wherein said first and second members are constructed of a synthetic plastic material.

23. The latch fastener according to claim 22 wherein said plastic material is at least one of polyvinyl chloride, ABS, nylon, and polypropylene.

* * * * *